United States Patent [19]

Roe

[11] Patent Number: 4,598,661

[45] Date of Patent: Jul. 8, 1986

[54] SAFETY SIGNAL DEVICE

[76] Inventor: Joan A. P. Roe, 1318 Sheridan Rd., Winthrop Harbor, Ill. 60096

[21] Appl. No.: 600,975

[22] Filed: Apr. 16, 1984

[51] Int. Cl.[4] ..... B63C 9/20

[52] U.S. Cl. ..... 116/209; 116/173; 441/89

[58] Field of Search ..... 116/209, 173, 174; 441/89; 2/247, 249, DIG. 6

[56] References Cited

U.S. PATENT DOCUMENTS

| | | | |
|---|---|---|---|
| 653,201 | 7/1900 | Ancevine | 441/89 |
| 692,278 | 2/1902 | Hamberger et al. . | |
| 1,121,510 | 12/1914 | Kinney | 116/173 |
| 3,104,644 | 9/1963 | Burton | 116/114 |
| 3,105,459 | 10/1963 | Conn | 116/209 |
| 3,106,184 | 10/1963 | Shea | 116/114 |
| 3,137,865 | 6/1964 | Evans et al. | 2/247 |
| 3,472,198 | 10/1969 | Rinecker | 116/114 |
| 3,624,686 | 11/1971 | Beals | 35/8 R |
| 3,872,529 | 3/1975 | Wainwright | 116/202 |
| 3,933,117 | 1/1976 | Maietta | 116/28 R |
| 3,946,699 | 3/1976 | Mirshak | 116/174 |
| 4,035,856 | 7/1977 | Oberg | 441/89 |
| 4,218,781 | 8/1980 | Lieberman | 2/247 |

*Primary Examiner*—Charles Frankfort
*Assistant Examiner*—Patrick R. Scanlon
*Attorney, Agent, or Firm*—Quarles & Brady

[57] ABSTRACT

A signal device for attachment to the flotation vest of a water skier to permit the skier to be more readily detected when in the water. The signal device includes a telescoping flag member and a support member to support the telescoping flag member in an upright manner. The support member has attachment devices such as cloth hook and loop fasteners to fasten the support member to the flotation vest.

14 Claims, 3 Drawing Figures

SAFETY SIGNAL DEVICE

BACKGROUND OF THE INVENTION

This invention relates to a signal device to be worn by a person to indicate their location. More particularly, this invention relate to a telescoping type signal flag which can be easily attached to the flotation vest of a water skier.

Signal devices to be utilized in conjunction with water safety or water skiers are shown in U.S. Pat. Nos. 692,278; 3,104,644; 3,106,184; 3,872,529 and 4,035,856. In U.S. Pat. No 3,946,699 an automatic flag storage and display device is depicted, and in U.S. Pat. No. 3,933,117 there is described a telescoping type warning device which can be utilized in conjunction with a car. U.S. Pat. Nos. 3,472,198 and 3,624,686 depict hook and loop type fastening devices with the device in the '198 patent utiized as a signaling member.

Nowhere in the the prior art is there illustrated a signal device which can be utilized in conjunction with a water skier's vest which has the advantage of being stored in a compact manner until time for utilization. Neither does the prior art afford a water skier's flag indicator which can be easily attached to a flotation vest and can be manufactured in an economical manner.

It is an advantage of the present invention to provide a signal device which can be easily secured to the clothing of a wearer. It is another advantage of this advantage to provide a warning indicator which includes a telescoping flag means for compact storage. It is still another advantage of this invention to provide a signal device which is easily secured to a water flotation vest as well as a signal device which is easily manufactured and can be fabricated at a minimum of cost.

SUMMARY OF THE INVENTION

The foregoing advantages are accomplished and the shortcomings of the prior art over come by the present signal device which includes telescoping flag means with a support member to support the telescoping flag means in an upright manner. Attachment means are operatively associated with the support member to attach the support member to the clothing of the wearer, such as a water skier's flotation vest. In a preferred embodiment, the support member is provided by a pocket member which includes two substantially U-shaped members joined together with a cover member placed over one side of the joined U-shaped members. The telescoping flag member includes a base member for securing to the pocket member and a flexible and folded panel member forming the flag is placed in the pocket member. The pocket member is fabricated to cover substantially all of the telescoping flag means which includes a telescoping pole member with an enlarged portion at the end thereof opposite the base. Attachment means in the form of adhesive cloth members extend from one of the U-shaped members opposite the cover member for attachment to the vest of the wearer.

BRIEF DESCRIPTION OF THE DRAWINGS

A better understanding of the present safety signal device will be accomplished by reference to the drawings wherein.

DESCRIPTION OF THE PREFERRED EMBODIMENT

Figure 1:
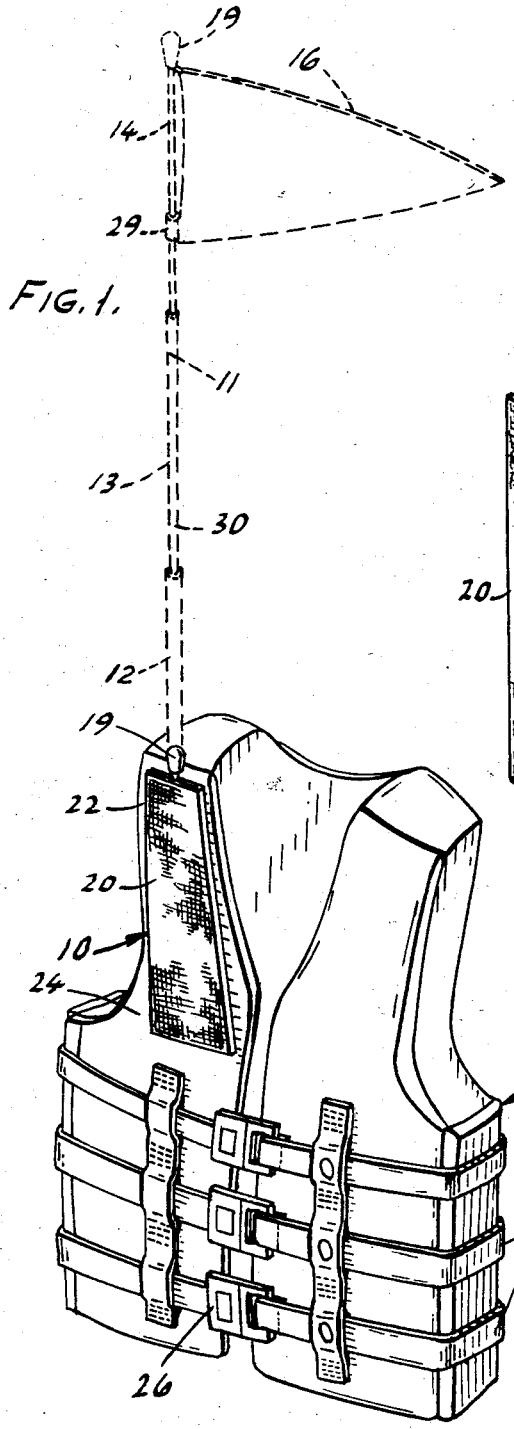
FIG. 1 is a perspective view of the water skier's vest showing the signal device of this invention attached thereto and with the telescoping flag means in an alternative erected position.

Proceeding to a detailed description of the present invention, the signal device generally 10 is shown specifically in FIG. 1 and utilized in conjunction with a water skier's flotation vest 23. A pocket member 22 houses telescoping flag means 11 which includes telescoping portions 12, 13 and 14. Flag portion 16 extends from telescoping portion 14, and an enlarged knob portion 19 is positioned at the end thereof. As indicated in FIG. 1, pocket member 22 is secured to vest front panel 24 of flotation vest 23 in a manner which will be explained in conjunction with FIGS. 2 and 3. Water skier's vest 23 is a commercially available unit with vest front panel 24 being fabricated from duck cloth. Vest 23 includes the usual vest straps 25 which are secured in the front by means of the usual snap buckles 26.

Figure 2:
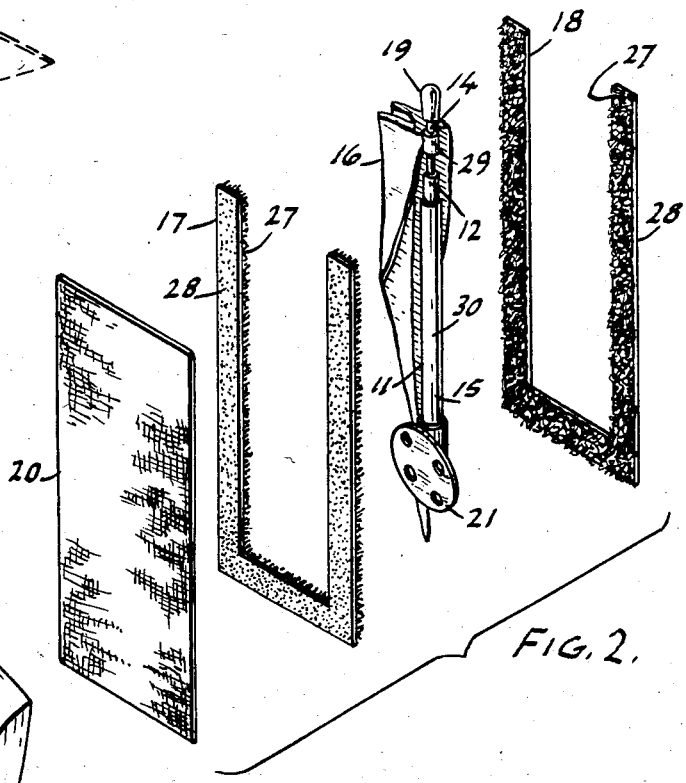
FIG. 2 is an assembly view of the signal device of this invention illustrating the basic components for fabrication.

As best seen in FIG. 2, two U-shaped members 17 and 18 are formed on one side such as 27 from a hook and loop type cloth material commonly known as Velcro and is available under this trademark. On the opposite sides is a tear away adhesive material 28. Folded flag portion 16 is attached to telescoping portion 14 by securing one portion such as by a metal staple and adhesive to the inside of enlarged knob portion 19 and another portion to slidable annular member 29. Base portion of signal device 10 extends from rigid plastic base member 21 which can be attached to cover member 20 such as by riveting or sewing it to cover member 20 at the bottom portion. Cover member 20 is formed from an open mesh plastic cloth and will be secured to U-shaped member 17 by adhesive side 28. When the two U-shaped members are joined as indicated in FIG. 3, cover member 20 and U-shaped members 17 and 18 will form a pocket member 22 for telescoping flag means 11 with base member 21 placed within the confines of U-shaped members 17 and 18.

Figure 3:
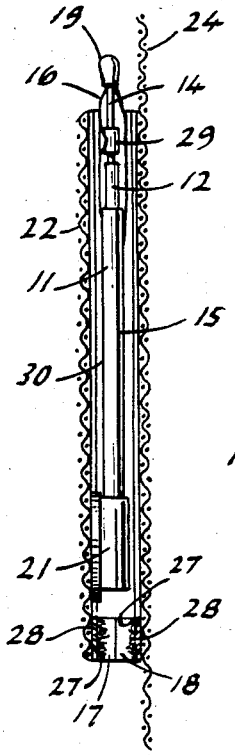
FIG. 3 is a view in verrtical section of the signal device illustrating it in the lowered position and affixed to a front panel of the water skier's vest shown in FIG. 1.

Referring to FIG. 3, it will be seen that U-shaped member 18 will in effect form a back wall when pocket member 22 is fastened to vest front panel 24. Base meber 21 of telescoping flag means 11 is fastened as previously explained to the inside of cover member 20 so as to support telescoping flag means 11 in an upright manner.

OPERATION

A better understanding of the advantages of the signal device 10 will be held by a description of its fabrication and operation. As indicated in FIG. 2, signal device 10 is easily fabricated by placing telescoping flag means 11 between U-shaped portions 17 and 18 which are secured to each other and will automatically become attached as they are composed of a hook and loop cloth. Also, the base member 21 of telescoping flag means 11 will be secured to the inside of cover member 20 such as has been previously stated. This sub-assembled pocket unit with flag portion 16 folded in a downward manner and cover 20 adhesively secured to U-shaped portion 17 can then be packaged and marketed in this manner or can be directly secured to flotation vest 23 by adhesively attaching U-shaped member 18 directly onto vest front panel 24 as specifically illustrated in FIG. 3.

With signal device 10 secured to vest 23, a person will wear the vest in the normal manner while water skiing. Should the wearer fall from the skis and go into the water, all the person need do then is to reach for enlarged knob 19 and pull upwardly causing slidable annular member 29 to slide down telescoping portion 14 and extending telescoping portions 12, 13 and 14 so as to place flag 26 in a position as indicated in FIG. 1. In this manner the water skier can be easily seen in the water through observance of flag portion 16 so as to be rescued as well as to indicate the exact position of the water skier so as not to be hit by another boater.

In the foregoing description, cover 20 was described as being composed of a mesh pastic cloth, and two U-shaped members 17 and 18 were described as being composed on one side of a hook and loop cloth type material and with adhesive on the other. If desired, other types of materials could be employed to provide the attachment means such as one piece of canvas or duck cloth which could be sewn directly to the flotation vest. The requirement is that the attachment means secure the support means in an upright position from the vest. Further, base member 21 is described as being of a rounded configuration. It can be of any geometric configuration such as a flat truncated triangular shape and attached to cover 20 such as by sewing the cover therearound. Preferably, flag portion 16 is formed from an orange-colored plastic such as a waterproof vinyl material for high visibility purposes and will measure approximately 12 inches by 6 inches by 11 inches. The telescoping rod 30 of the telescoping flag means 11 will extend two feet when fully extended. Pocket member 22 is preferably 6 inches long to receive the collapsed telescoping rod 30, it can be of any dimension or configuration including triangular.

While safety signal device 10 has been described for use in conjunction with a water skier, it is obvious that it could be employed in any situation where a distress type signal is to be given. For example, it could be worn by an explorer who must traverse high growth vegetation such as brush or a field; it could be employed such as with scouting troops to give an indication of position or could be employed by snow skiers, or by swimmers or in any circumstance where a signaling device is needed while leaving the user's hands free to perform other tasks.

It will thus be seen that through the present invention there is now provided a signal device which is easily fabricated, is compact and can be easily worn. The telescoping signal device of this invention is compact and easily activated. No special tools need be employed to fabricate it and no special skills are required for activation. While serving as a signal device, the device of this invention also has an inherent safety feature. If for some reason the telescoping rod or the pocket member become entangled with a foreign object such as the skier's rope, it will be automatically separated from the skier's vest because of the adhesive and hook and loop fastening.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A signal device to be secured to the clothing of a wearer comprising:

telescoping flag means;

a support member defining a pocket member constructed and arranged to be connected to said telescoping flag means and to support said telescoping flag means in an upright manner, said pocket member including at least two opposing members joined together by first attachment means; and a second attachment means operatively associated with said support member to attach and secure said support member to the clothing of a wearer, said first attachment means constructed and arranged to permit detachment of said opposing members of said support member and said second attachment means can be constructed and arranged to permit detachment of said support member from said clothing whereby when a force is exerted on said flag means or said support member, one of said first or second attachment means can release.

2. The signal device as defined in claim 1 wherein said telescoping flag means includes a base member for securing to said pocket member.

3. The signal device as defined in claim 2 wherein said pocket member includes two substantially U-shaped members joined together by said first attachment means; and said telescoping flag means includes a flexible panel member; said flexible panel member and said base member placed therebetween and a cover member placed over one side of said joined U-shaped members, said second attachment means connected to a side of said joined U-shaped members opposite said cover member.

4. The signal device as defined in claim 2 wherein said telescoping flag means includes a flexible flag member adapted to be folded into said pocket member.

5. The signal device as defined in claim 4 wherein said pocket member is constructed and arranged to cover substantially all of said telescoping flag means when unextended.

6. The signal device as defined in claim 5 wherein said telescoping flag means includes a telescoping pole member with an enlarged portion at the end thereof opposite the base member.

7. The signal device as defined in claim 6 wherein said first attachment means is of the hook and loop type.

8. A signal device to be secured to a person's vest comprising:

telescoping flag means;

a support member defining a pocket member composed in part of cloth material constructed and arranged to be connected to said telescoping flag means and to support said telescoping flag means in an upright manner, said pocket member including at least two opposing members joined together by attachment means; and cloth attachment means operatively associated with said support member to attach and secure said support member to said vest, said attachment means constructed and arranged to permit detachment of said opposing members of said support member and said cloth attachment means can be constructed and arranged to permit detachment of said support member from said clothing whereby when a force is exerted on said flag means or said support member, one of said attachement means can release.

9. The sigal device is defined in claim 8 wherein said telescoping flag means includes a base member for securing to said pocket member.

10. The signal device as defined in claim 9 wherein said pocket member includes two substantially U-shaped members joined together by said attachment means; and said telescoping flag means includes a flexible panel member; a portion of said flexible panel member and said base member placed therebetween and a cover member placed over one side of said joined U-shaped members, said attachment means connected to a side of said joined U-shaped members opposite said cover member.

11. The signal device as defined in claim 9 wherein said telescoping flag means includes a flexible flag member adapted to be folded into said pocket member.

12. The signal device as defined in claim 11 wherein said pocket member is constructed and arranged to cover substantially all of said telescoping flag means when unextended.

13. The signal device as defined in claim 12 wherein said telescoping flag means includes a telescoping pole member with an enlarged portion at the end thereof opposite the base member.

14. The signal device as defined in claim 13 wherein said cloth attachment means is of the adhesive cloth type.

* * * * *